US005113163A

United States Patent [19]

Leupold

[11] Patent Number: 5,113,163

[45] Date of Patent: May 12, 1992

[54] ADJUSTABLE MAGNETIC FIELD SUPERCONDUCTING SOLENOID

[75] Inventor: Herbert A. Leupold, Eatontown, N.J.

[73] Assignee: The United States of America as represented by the Secretary of the Army, Washington, D.C.

[21] Appl. No.: 612,281

[22] Filed: Nov. 13, 1990

[51] Int. Cl.[5] ..... H01F 7/22; H01F 1/00

[52] U.S. Cl. ..... 335/216; 335/296; 174/125.1

[58] Field of Search ..... 335/216, 296, 295; 29/599; 505/879, 924; 174/125.1

[56] References Cited

U.S. PATENT DOCUMENTS

| | | | |
|---|---|---|---|
| 3,239,726 | 3/1966 | Barsch | 335/295 |
| 3,436,258 | 4/1969 | Neugebauer | 29/599 |
| 4,327,244 | 4/1982 | Horvath et al. | 174/125.1 |
| 4,409,579 | 10/1983 | Clem | 335/216 |

FOREIGN PATENT DOCUMENTS

| | | | |
|---|---|---|---|
| 59-58803 | 4/1984 | Japan | 335/216 |
| 63-313809 | 12/1988 | Japan | 335/216 |

OTHER PUBLICATIONS

Babiskin, Julius; *Magnetic Properties of a Hollow Superconducting Lead Sphere*, Physical Review, vol. 5, No. 1, pp. 104-106.

*Primary Examiner*—Leo P. Picard
*Assistant Examiner*—Trinidad Korka
*Attorney, Agent, or Firm*—Michael Zelenka; William H. Anderson

[57] ABSTRACT

A cylindrical superconducting solenoid adapted to receive cylindrical inserts within the bore thereof. The inserts are selected having a permeability or radial thickness which will absorb or conduct a portion of the magnetic field within the interior bore of the cylindrical solenoid. Thereby, the interior magnetic field can be adjusted to any predetermined value without changing the total amount of trapped flux within the superconducting solenoid.

7 Claims, 1 Drawing Sheet

FIG. 1
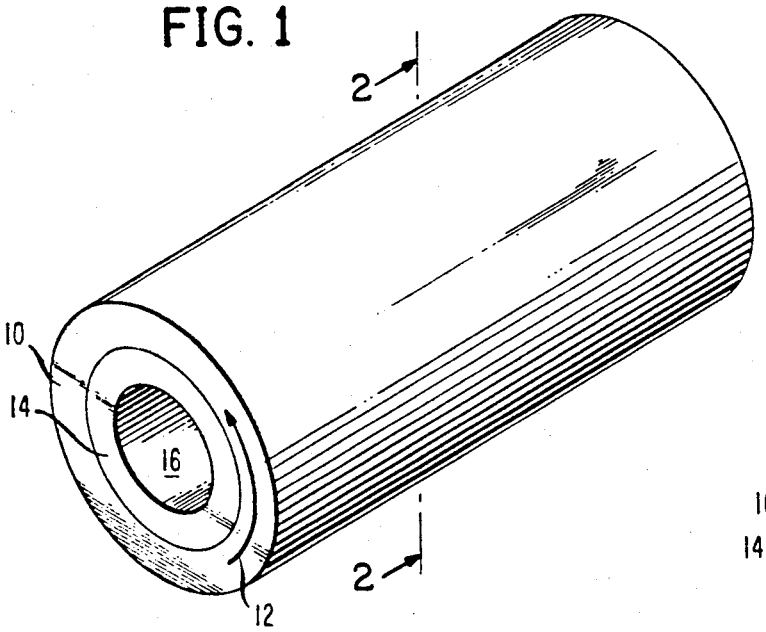
FIG. 2
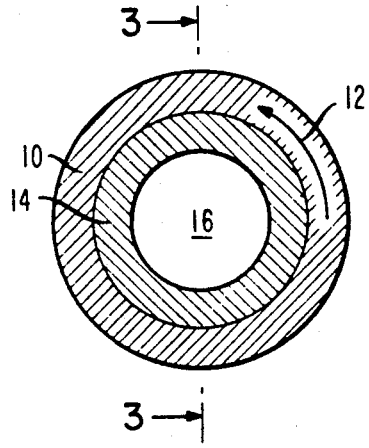
FIG. 3
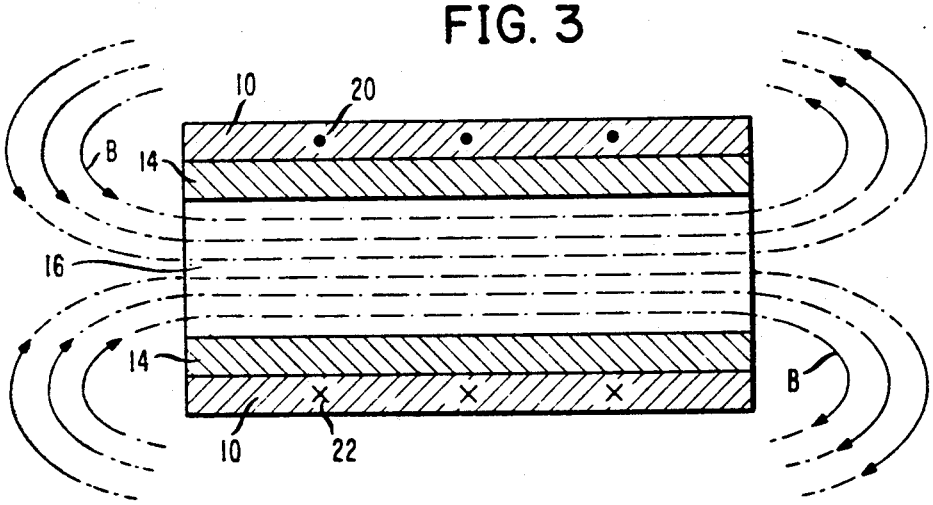
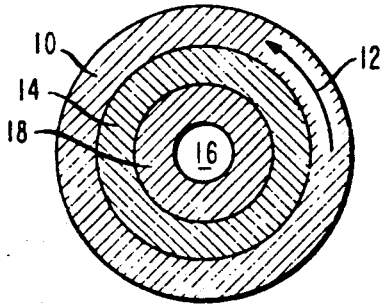
FIG. 4

ADJUSTABLE MAGNETIC FIELD SUPERCONDUCTING SOLENOID

GOVERNMENT INTEREST

The invention described herein may be manufactured, used, and licensed by or for the government for governmental purposes without the payment to me of any royalty thereon.

FIELD OF THE INVENTION

This invention relates generally to superconducting solenoids and more particularly, to a superconducting solenoid that has an adjustable uniform axial magnetic field therein.

BACKGROUND OF THE INVENTION

Solenoids are common, and have many practical applications where an axial magnetic field is desired. Such practical applications include such devices as electron beam tubes. Typically, solenoids are made of a long wire wound in a close packed helix forming a cylindrical tube. When current is passed through the wire, a magnetic field is created. If the length of the solenoid is long compared to its diameter, an axial substantially uniform magnetic field is created within the bore of the solenoid. The magnitude of this magnetic field is controlled by the current within the wire forming the solenoid. The larger the current, the greater the magnetic field created. Therefore, for applications that require predetermined magnetic fields, the magnetic field necessary is generated by controlling the current within the wire forming the solenoid.

With the proliferation of superconductivity and its resulting practical applications, difficulties have arisen. When a persistent current flows in a superconducting solenoid, thereby forming an axial magnetic field within, the persistent current is not easily controlled once it has been established. For this reason, difficulties have been encountered in adjusting the magnetic field within a superconducting solenoid once the persistent current has been established. Therefore, there is a need for controlling the magnetic field generated by a superconducting solenoid once a persistent current is established therein.

SUMMARY OF THE INVENTION

In general, the present invention is directed to an apparatus for creating an adjustable magnetic field without the need for direct control of the persistent current in a superconducting solenoid. The present invention comprises a superconducting solenoid having an axial magnetic field created therein and at least one insert adapted to fit within the superconducting solenoid, and being made of a material that will absorb a portion of the magnetic flux within the superconducting solenoid so that the magnetic field therein is reduced. The radial thickness of the insert varies, depending upon the amount the magnetic field is desired to be reduced. Alternatively, the magnetic permeability of the insert is selected to controllably reduce the magnetic field within the superconducting solenoid.

Therefore, it is an object of the present invention to control the magnetic field within a superconducting solenoid.

It is yet another object of the present invention to control the magnetic field while maintaining a constant total trapped magnetic flux within the superconducting solenoid.

It is an advantage of the present invention that multiple inserts of different diameters may be used to obtain the desired magnetic field.

It is another advantage of the present invention that fine adjustments can be made to obtain the desired magnetic field.

It is a feature of the present invention the radial thickness of each insert is varied.

It is another feature of the present invention that each insert can have a constant radial thickness but be made of a material having a predetermined permeability.

These and other objects, advantages, and features will become more readily apparent in view of the following more detailed description and drawings.

BRIEF DESCRIPTION OF THE DRAWINGS

FIG. 1 is a perspective view of one embodiment of the present invention.

FIG. 2 is a cross section taken along line 2—2 in FIG. 1.

FIG. 3 is a cross section taken along line 3—3 in FIG. 2 illustrating the magnetic field.

FIG. 4 is a cross section of another embodiment of the present invention.

DETAILED DESCRIPTION OF THE PREFERRED EMBODIMENTS

FIG. 1 generally illustrates one embodiment of the present invention. A cylindrical tube 10 is made of a superconducting material. When a persistent current, represented by arrow 12, is generated within the tube 10 a magnetic field is established within bore 16. The persistent current, represented by arrow 12, can be generated by either of two methods. The first method is to place the tube 10 in the appropriate magnetic field while it is above its transition temperature, and therefore in the normal phase. The tube 10 is then cooled to below its transition temperature so that it becomes superconducting. The applied magnetic field is then removed and the persistent current which is induced by the removal sustains the originally applied magnetic flux in the interior bore 16 of the tube 10. The magnetic flux is therefore trapped. The second method is to cool the tube 10 below its transition temperature therefore, making the tube 10 superconducting. The tube 10 is then place in a magnetic field greater than the critical field so that the tube 10 looses its superconducting property and becomes normal allowing the magnetic flux to penetrate uniformly throughout its interior. The magnetic field is then removed causing the tube 10 to become superconducting thereby trapping the magnetic flux within the interior bore 16.

Either of these two methods will create a persistent current, represented by arrow 12, sufficient to maintain the magnetic field within bore 16. The magnitude of the magnetic field within bore 16 is determined by the persistent current, represented by arrow 12, flowing on the surfaces of tube 10. In order to control the magnitude of the resulting magnetic field within bore 16, an insert 14 is placed within the bore 16 of tube 10. The insert or shell 14 is made of a flux absorbing material. A ferromagnetic material having a large permeability, such as iron, may be used. However, the ferromagnetic material should be of the soft or passive type preferably having a very low coercivity. When the insert 14 is inserted into the bore 16 of tube 10, the large permeability of the insert 14 will cause it to saturate with magnetic flux, conducting a portion of the magnetic flux formerly within bore 16. This decreases the magnetic flux density within bore 16 and, therefore, decreases the resulting magnetic field along the longitudinal length of the tube 10. The radial thickness or permeability of the insert 14 must permit saturation at a flux density less than that contained originally within bore 16. Therefore, insert 14 can be configured to absorb or conduct a predetermined amount of magnetic flux to provide any desired magnetic field within bore 16. The greater the radial thickness or the permeability, the greater the reduction of the magnetic field within bore 16.

FIG. 2 illustrates a lateral cross section of one embodiment of the present invention. The outside diameter of insert 14 is selected to closely match the inside diameter of tube 10, but permit easy insertion within tube 10. The radial thickness, or the distance between the inner and outer diameter of insert 14, can be held constant to result in a constant diameter bore 16 regardless of the insert used or degree of magnetic field attenuation desired. This is made possible by selecting the permeability of the material of which insert 14 is made. The permeability of the material is selected such that an adjustment in the interior magnetic field can be made by any desired degree. For example, if the interior field within bore 16 is to be reduced greatly, a material having a large saturation magnetic flux density should be selected, and if the interior field is to be reduced only slightly, a material having a low saturation magnetic flux density should be selected.

In the alternative, the radial thickness of the insert 14 can be varied while maintaining the same material and therefore, a constant permeability. In this way, the interior magnetic field can be adjusted by any desired amount by varying the radial thickness of the insert 14. The amount of magnetic flux absorbed or conducted is proportional to the cross sectional area of the insert. Therefore, the greater the thickness, the greater the cross sectional area, and therefore the amount of magnetic flux capable of being absorbed or conducted away from the interior bore 16.

In FIG. 3, the magnetic field B is illustrated. The magnetic field B is created or maintained by the persistent current flowing within tube 10. The persistent current is illustrated in FIG. 3 by dots 20 and Xs 22. Dots 20 represent an arrowhead illustrating the direction of current flowing within tube 10 to be pointed out of the plane of the paper. A Xs 20 represent the tail of an arrow illustrating the current flowing within tube 10 to be pointed into the plane of the paper. As illustrated in FIG. 3, the insert 14 extends the entire length of tube 10. A portion of the magnetic field, after the insertion of insert 14, will be conducted, carried, or absorbed within the insert 14. Therefore, the magnetic field and resulting magnetic flux density within bore 16 will be reduced by the amount of magnetic flux density capable of flowing within insert 14. Therefore, the magnetic field within bore 16 can be adjusted by any desired degree without changing the persistent current flowing within superconducting tube 10.

FIG. 4 illustrates another embodiment of the present invention. In FIG. 4, a second flux absorbing insert 18 is illustrated inserted within first insert 14. The embodiment in FIG. 4 illustrates that multiple inserts 14 and 18 can be used to adjust the interior magnetic field within bore 16 by varying amounts. Therefore, a plurality of standard value inserts can be combined or nested in various ways to achieve a cumulative adjustment of the interior magnetic field within bore 16 without changing the total magnetic flux in superconductor tube 10.

It should be understood that the embodiments depicted and described can be combined in different configurations, and that numerous modifications or alterations may be made therein without departing from the spirit and scope of the invention as set forth in the appended claims.

What is claimed is:

1. A superconducting solenoid with an adjustable magnetic field comprising:

a cylinder having a bore extending along the longitudinal axis of the cylinder, the cylinder being made of superconducting material capable of producing a magnetic field within the cylinder; and an insert having a diameter adapted to fit within the bore of the cylinder and being made of a ferromagnetic material, whereby the insert absorbs a portion of the magnetic field produced by the cylinder when the insert is placed within the bore of the cylinder.

2. An adjustable superconducting solenoid as in claim 1 wherein:

said insert will saturate before the complete reduction of the magnetic field within the bore.

3. An adjustable superconducting solenoid as in claim 1 wherein:

said insert has a predetermined radial thickness to produce a desired interior magnetic field within the bore.

4. An adjustable superconducting solenoid as in claim 1 wherein:

said insert has a predetermined permeability to produce a desired magnetic field within the bore.

5. An adjustable superconducting solenoid comprising:

a cylinder having a bore extending along the longitudinal axis of the cylinder, the cylinder being made of superconducting material capable of producing a magnetic field within the bore of the cylinder when a persistent current is present within the cylinder; and a plurality of nesting inserts, each adapted to fit within the bore of the cylinder and each made of a material capable of absorbing a portion of the magnetic field within the bore of the cylinder.

6. An adjustable superconducting solenoid as in claim 5 wherein:

each said plurality of nesting inserts is made with a different radial thickness.

7. An adjustable superconducting solenoid as in claim 5 wherein:

each of said plurality of nesting inserts is made of a material having a different magnetic permeability.

* * * * *